United States Patent [19]

Peterseim et al.

[11] Patent Number: 4,544,138

[45] Date of Patent: Oct. 1, 1985

[54] DISCHARGE OF TOP GASES FROM BLAST FURNACES OR THE LIKE

[75] Inventors: Heinz Peterseim, Zweibruecken; Walter Leutz, Bierbach-Wolfersheim, both of Fed. Rep. of Germany

[73] Assignee: Mannesmann AG, Duesseldorf, Fed. Rep. of Germany

[21] Appl. No.: 559,572

[22] Filed: Dec. 8, 1983

[30] Foreign Application Priority Data

Dec. 8, 1982 [DE] Fed. Rep. of Germany ..... 3245374

[51] Int. Cl.[4] ..... C21B 7/22

[52] U.S. Cl. ..... 266/44; 266/147; 266/154; 266/157

[58] Field of Search ..... 266/44, 144, 145, 147, 266/154, 157, 197

[56] References Cited

U.S. PATENT DOCUMENTS 4,055,331 10/1977 Hegemann ..... 266/147

4,315,619 2/1982 Inoue et al. ..... 266/144

*Primary Examiner*—L. Dewayne Rutledge

*Assistant Examiner*—Robert L. McDowell

*Attorney, Agent, or Firm*—Ralf H. Siegemund

[57] ABSTRACT

During the charging of a blast furnace with a new raw material, gas with a high dust content enters and pressurizes the storage bin. This pressurized gas is fed to one end of a temporary storage chamber in the form of an elongated tube having a discharge opening with a noise attenuator at the other end. When the storage tube is filled, it is connected to a low pressure suction device for removing the dust laden gas from the storage tube. The equipment is described with twin bins and alternating discharge therefrom using the same temporary storage tube.

11 Claims, 1 Drawing Figure

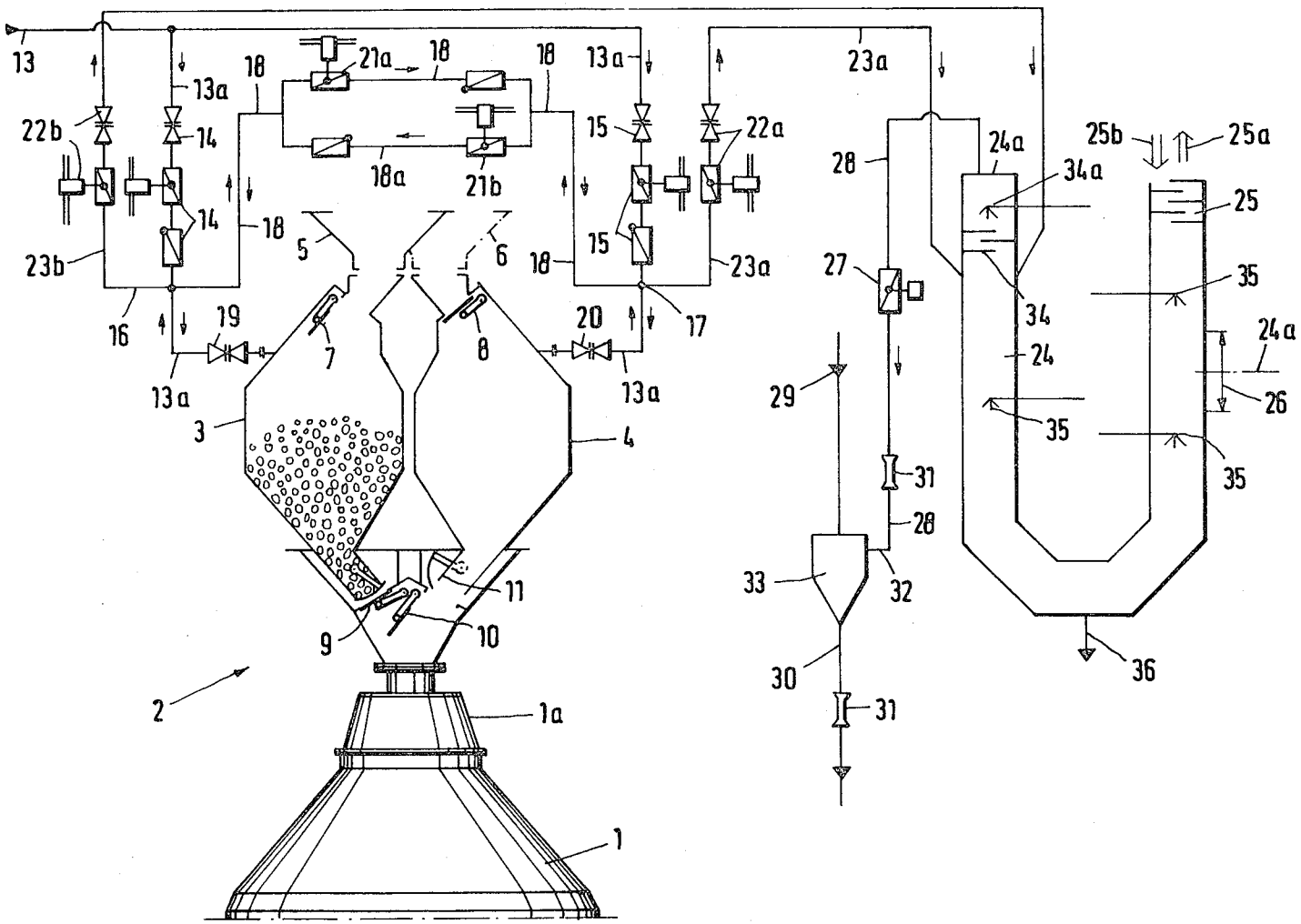
1
1a
2
3
4
5
6
7
8
9
10
11
13
13a
14
15
16
17
18
18a
19
20
21a
21b
22a
22b
23a
23b
24
24a
25
25a
25b
26
27
28
29
30
31
32
33
34
34a
35
36

DISCHARGE OF TOP GASES FROM BLAST FURNACES OR THE LIKE

BACKGROUND OF THE INVENTION

The present invention relates to the reduction of the pressure of waste, top or blast furnace gases which may flow from a blast furnace into a bin having lock placed operationally ahead of the blast furnace which gases are subsequently decompressed in relation to each other or in a special gas container, the gases are to be discharged into the free atmosphere through noise-attenuating equipment.

Gases are developed in blast furnaces, for example, and they required discharge, for example, every 150 seconds. Depending upon the size of the furnace such a discharge may involve about one thousand four hundred cubic meters. The discharge, of course, poses a particular problem because it contains dust and the relatively large volume involved here entails the development of a considerable amount of dust.

The removal of these blast furnace or top gases develop basically for reasons of internal pressure equalization is theoretically possible in accordance with two principles. The first principle assumes that the gas occurs on a discontinuous and can accordingly be discontinuously discharged into the outer atmosphere. The second principle involves capturing the gas, treating it and using it some practical manner.

German Pat. No. 29 45 045 discloses a method of the first mentioned kind, i.e. a method in which intermittently the gas is discharged through a sound attenuating device and contains a certain amount of dust. Considering the state of the art, one could consider de-dusting equipment of gas-scrubbing device or plant which commensurate with the discontinuous discharge of top gases remove the dust or a considerable portion thereof in a correspondingly matched process. An assumed volume of sixty cubic meter dust containing gas at a rate on the order of 1,400 cubic meter per second a quantity of 80,000 cubic meters per hour would have to be processed. The de-dusting or scrubbing equipment has to accommodate such quantity. In fact, a de-dusting and dust-scrubbing plant would have to be about sixty times as large as would be necessary if continuous operation were possible. It can thus be seen that de-dusting is a very costly procedure, particularly considering the equipment would run idle but still consume energy.

Another method for removing the dust laden top gas resulting from the pressure equalization in the blast furnace is disclosed in German patent application No. 30 26 019. A low pressure stage is provided in a dust precipitator and decompression is provided for in relation to the counterpressure of the top gas network. Also here all dust removal vessels have to be designed to accommodate the instantaneously arriving gas quantity. Therefore, this dust removal and dust scrubbing equipment is likewise very expensive. Moreover, this particular equipment poses another problem because of the high rate of cleaning, i.e. low proportion in dust which the gas has to have and must not exceed upon discharging. Moreover, this so-called closed system requires a partitioning of the dust scrubbing into a precleaning and postcleaning operation. This is necessary in order to be able to feed the pressure equalization top gas from a low pressure state back into an intermediate stage in the top gas network.

DESCRIPTION OF THE INVENTION

It is an object of the present invention to provide a new and improved method and equipment for the discharge of blast furnace top gases as they become available, for example, during the charge process of the furnace under utilization of appropriate scrubbing procedure in order to remove dust from that gas.

In accordance with the preferred embodiment of the present invention it is suggested to extract the dust-laden, high-pressure blast furnace top gas as it has been collected, for example, in a charge and storage bin for the furnace into a temporary storage chamber being, for example, an elongated tube receiving that gas at one end; the tube is normally filled with air at normal temperature and has at its other end a noise attenuator so that as the top gas at elevated pressure flows into the storage tube the air is displaced from the storage tube and discharges therefrom through the noise attenuator; as soon as the top gas has just about reached that noise attenuator the gas flow of top gas into the storage tube is stopped and the same end of the storage tube is now connected to a low pressure suction device, reversing the gas flow in the storage tube and sucking the dust laden gas out of that tube. The top and blast furnace gas, while in the storage tube, may already be subjected to certain scrubbing and the suction device removing the top gas from the storage tube will preferably feed that gas through a scrubber before it is used otherwise. Thus, only a small portion per unit time of the top gas is fed through scrubbing equipment whereby existing scrubbing equipment can readily be used and additional dedusting and scrubbing is not necessary. Rather, the invention can be practiced in an environment in which for other reasons scrubbing, dedusting and decontamination is provided for and the procedure as per the invention permits a gradual inclusion of this top gas into the gas flow generally that runs through the already available scrubbing and dedusting equipment. In other words, the temporary storage feature provided by the invention permits the dust laden gas to be processed gradually rather than in the instant of discharge from the relative high-pressure stage above the blast furnace.

In furtherance of the invention, it is suggested to dilute the dust laden gas as it is discharged from the storage tube at a dilution ratio of at least 3:1. This dilution avoids the danger of explosion which is particularly important if the dedusting equipment generally includes electrically operated filters. The discharge of dust laden gas from the storage bin is carried out under conditions which make available at least 30% larger volume than occupied by the pressurized top gas prior to discharge into the storage tube. This feature avoids undesired discharge of the gas from the storage tube through the noise attenuator. For a practical case in the general field of blast furnace operation the situation is such that the suction of top gas from the storage tube should occur not later than five seconds after the displacement of air from that storage tube. This way time is saved and the storage bin does not have to be increased over the normal dimensions. Moreover, a certain safety zone is provided so as to avoid that dust laden gas exits from the storage tube through the noise attenuator.

In furtherance of the invention, the temporary storage of the dust laden top gas can be used to provide in a very simple manner a highly effective dedusting by spraying the gas with water so that a considerable portion of the dust is already removed in this fashion. Moreover, this water is used simultaneously to clean the storage tube because it is used over and over again during blast furnace operation.

In a practical manner a twin set of storage bins for raw blast furnace charges is provided operating in an alternating fashion, and accordingly top gas is discharged from them likewise in alternating operation through appropriate belt controlled pressure lines leading basically to the same entrance of the temporary storage tube. For this reason, it is advisable to provide in addition occasionally operated pressure equalization lines which are effective between the two storage bins. Also, a separate valve control conduit means should be provided in order to pressurize the storage bins individually following discharge in order to permit adaptation of the bin pressure to the pressure of the blast furnace.

The storage tube mentioned above should already be provided with a mixing zone because the advancing pressure wave does not by and in itself establish mixing with air. This, of course, is basically highly desirable and it is for this reason that the storage facility for the dust laden gas is a tube. This construction permits the higher pressure dust laden gas to push the air content from the elongated storage tube into the outer atmosphere without inclusion of dust laden gas. On the other hand, subsequently to the filling of the storage tube with dust laden gas, dilution is indeed desirable as much as possible.

A certain quantity measuring and controlling structure is to be provided in the suction line by means of which the gas is sucked out of the storage tube. This way, one avoids that the pressure wave does also penetrate into the suction system. Moreover, a certain control of the dilution of the dust laden top gas during the suction out of the storage tube is indeed desired. Various quantity flow measuring devices may be provided in various locations in order to have a better control over the gas flow conditions in the various parts of the equipment. A drop precipitator should be provided inside the storage tube in order to avoid that scrubbing and spray water used inside the storage tube is also sucked out of the suction system. A mixing chamber at the entrance of the discharge line from the storage tube into the suction line avoids deflagration.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1, the only FIGURE of drawing, illustrates somewhat schematically a cross section through the upper part of a blast furnace and equipment for obtaining a pressure equalization between the charge bins with lock and the blast furnace, the drawing includes also a system diagram illustrating a preferred embodiment of the present invention for practicing the best mode thereof.

Proceeding now to the detailed description of the drawings, the FIGURE illustrates a high pressure operated blast furnace 1. The tubing through which the top or blast furnace gas is taken from the furnace are not illustrated because such tubing is not immediately relevant for practicing the invention. Suffice it to say that they exist in the conventional manner. A gas lock 2 is provided above the head 1*a* of the blast furnace. This lock is comprised essentially of the two bins 3 and 4 being provided with suitable locks themselves including elements to be described next.

Charge funnels 5 and 6 are respectively associated with each of the bins 3 and 4 to replenish the content of the bin with raw material to be processed by the furnace 1. The bins 3 and 4 can be closed in relation to the outer atmosphere by means of sealing flaps 7 and 8 respectively. These flaps constitute part of the lock structure. The discharge opening of each of these two bins 3 and 4 is also provided with a sealing flap being respectively denoted with numerals 9 and 10 for the two bins. There are holding flaps 11 provided for control of the charge flow.

Clean top gas is extracted from a conventional dedusting equipment (not shown) by means of a conduit 13 and is fed to the bins 3 and 4 through branch lines 13*a* and 13*a'*. The purpose thereof is to pressurize the content of the bins until their internal pressure is the same as the pressure inside the blast furnace. Valves 14 and 15 are provided in order to selectively control the flow of this gas onto the bins 3 and 4.

Branch points 16 and 17 for top and furnace gas are connected to a pressure equalization conduit 18 which interconnects the two bins 3 and 4 for purposes of decompressing the respective higher pressure in one or the other of the two bins. Pressure equalization is thus obtained through direct interconnection between the two bins. Each of the two bins 3 and 4 can, furthermore, be separated through valves 19 and 20 respectively from the entire tube and conduit system. The gas that flows through the conduit 13, the branch conduit 13*a* and 13*a'*, as well as any gas flowing in the pressure equalization tubing 18 may run through a bypass 18*a* in reverse flow fashion. The forward and reversing flow through lines 18 and 18*a* is controlled through valves 21*a* and 21*b*.

The components as described thus far are basically provided in order to obtain pressure equalization between the blast furnace 1 on one hand and each of the bins 3 and 4 on the other hand, or between the two bins themselves. The pressure in the blast furnace may be about 2.5 bars. Assuming that bin 4 has just discharged into the blast furnace and assuming that fresh raw charge is to be provided anew for the bin 4, essentially a pressure reduction in that bin to atmospheric pressure is required. During the charge of the blast furnace the pressure in bin 4 had dropped to about 1.8 bars but now the pressure has to be reduced to about 1 bar so that the sealing flap 8 can be opened without exertion of an undue large force so that bin 4 may receive new burden.

The aforementioned situation is roughly to be repeated every hour and involves alternatingly the bins 3 and 4. In order to obtain the charge operation of bin 4 the flaps 8 and 10 have to be closed and the valves 15 have to be closed also, but a valve 22*a* will be opened. The top gas laden with dust in bin 4 can now advance into a storage tube 24 under formation of a pressure wave and through a bin-to-gas tube line 23*a*. This gas flow traverses the tubing 24 and will have reached the entrance position 24*a* after about five seconds. The air contained in storage tube 24 is being displaced by this advancing gas flow and is forced into the outer atmosphere through a noise attenuator 25. Reference numeral 25*a* denotes an arrow which symbolizes this flow of air. The top gas pulse can move up to the mixing zone 26 in storage tube 24 and it is assumed that the dust laden top and blast furnace gas will be mixed in this zone 26 with clean air to thereby reduce the relative dust content. Thus, storage tube 24 serves as a temporary storage chamber for the top gas.

As soon as the top gas is about to reach attenuator 25 gas line 23*a* is closed by means of the valve 22*a* while a quantity control member 27 opens. In a practical situation this member 27 is a tube flap which is continued into a line or conduit 28. The tubular conduit 28 is connected to a suction device 29-33-30 as well as to the front end 24*a* of the storage tube 24. The suction device constitutes the low pressure stage of the equipment.

It can readily be seen that any gas discharge from bin 3 is run through corresponding components. The flaps 7 and 9 are closed in this case while the valve 22*b* is open. A pressure wave migrates through the conduit 23*b* in a similar fashion into the storage tube 24 to displace the air therein. Arrow 25*a* is likewise representative of the movement of air through the sound attenuation 25 and into the free atmosphere in this situation. The process continues with the closing of the line 23*b* by means of the valve 22*b* and continues as will be described.

The suction equipment or device 29 is not illustrated in great detail because such suction equipment is conventionally a component of a blast furnace installation. Such a suction device can be constructed in a variety of manner. The basic function is to produce a low pressure of an auxiliary gas such as air or nitrogen. Suction commences, in effect, upon closing of valve 22*a* or 22*b*. The dust laden top gas is sucked out of storage bin 24 and fed through a suction line 30 through a scrubbing and de-dusting device which is not shown. A flow quantity meter 31 such as a venturi nozzle is arranged in the suction line 30. The mixing chamber 33 is provided at the end 32 of conduit 28 where communicating with the suction conduit 30. The mixing ratio of air to top gas will be adjusted to 3:1 or even higher by means of the quantity control member 27 in order to avoid deflagration although for correspondingly and appropriately thick walls of the storage conduit 24 and of the mixing chamber 33 as well as other members that would not pose any danger.

A drop precipitator 34 is provided inside storage conduit 24 and a water nozzle 34*a* is associated with this precipitator 34. Precipitator 34 as well as nozzle 34*a* are operational or, better, in operation, whenever the aforementioned pressure wave is initiated. Nozzles 35 provide scrubbing and removal of dust residue. Feeding water through the nozzles 35 is carried out only upon sucking the top gas back, i.e. whenever the suction device 29 is set in operation and extracts the top gas from the storage conduit 24. A certain de-dusting is carried out already inside storage conduit 24 and the dust is removed together with the water by means of a wastewater outlet 36.

The suction conduit 30 may run to a general de-dusting and scrubbing equipment as it is provided in the hall that contains the blast furnace. There may be suction points at the discharge outlet of the blast furnace itself, and other equipment may be provided with suction locations such as the raw charge duct, the conveying equipment, other storage bins and the like. This suction equipment is available already and establishes a very large suction power.

The gas sucked through the conduit 28 will cause clean air to enter the equipment through the sound and noise attenuator 25 but now in the direction of arrow 25*b*. The long term suction of fresh air makes it possible to flush the storage conduit 24 several times over to make sure that no top gas residue remains because the next pressure wave of the pressure equalization gas would force such residue out of the storage conduit 24 which has to be avoided.

The invention is not limited to the embodiments described above but all changes and modifications thereof not constituting departures from the spirit and scope of the invention are not to be included.

We claim:

1. Method of reducing the pressure of top gases discharged from a blast furnace or the like into a storage bin during discharge of the content of the bin into the blast furnace, comprising the steps of:

feeding in a first phase dust laden top gas at elevated pressure into a chamber filled with clean air at ambient temperature and pressure under utilization of the formation of a pressure wave;

concurrently discharging said air by operation of said pressure wave through a sound attenuation device into the outer atmosphere;

feeding in a second phase the top gas from said chamber under dilution with clean air into a low pressure stage under concurrent separation from the storage bin from which the top gas was discharged in said first phase; and de-dusting the diluted top gas as discharged from said low pressure stage.

2. Method as in claim 1 wherein said dilution step is carried out outside of said chamber, the dilution being at least 3 to 1.

3. Method as in claim 1 including the step of providing said chamber such that the volume available for the top gas is at least 30% larger than the top gas volume itself.

4. Method as in claim 1, the suction of the top gas pursuant to said second phase is commencing not later than five seconds after said air was discharged through the sound attenuation device.

5. Method as in claim 1 and comprising the additional step of spraying water into said chamber during said second phase.

6. Apparatus for handling top gas developed in a feed bin, having suitable lock means, and being intermittently connected to a blast furnace for purposes of providing a new charge to said blast furnace whereby top gas reaches and flows into said bin comprising:

first valve controlled conduit means permitting discharge of top gas from said bin;

a storage tube connected to said first conduit and having a volume sufficient to receive all of the top gas that flows from the bin through said first conduit means, said first conduit means being connected to said storage tube near one end thereof;

a sound and noise attenuator provided at the other end of said storage tube being otherwise open to the outer atmosphere; and a suction device including a separate valve device connected to said storage tube at said one end thereof, for sucking top gas out of the storage tube after the storage tube has filled with top gas and the previous air content thereof has been discharged through said sound attentuating device.

7. Apparatus as in claim 6 and including air dilution means in said discharge path for diluting the top gas as it is being sucked from said storage tube at a dilution rate of at least 3:1 with clean air.

8. Apparatus as in claim 7 there being a mixing chamber provided in the suction device by means of which said storage tube is discharged.

9. Apparatus as in claim 6 including drop precipitation means in said storage tube.

10. Apparatus as in claim 6 there being a second storage bin, an additional conduit means connecting the second storage bin to said storage tube, the additional conduit means including valves so that said two storage bins alternatingly discharge said top gas into said storage tube.

11. Apparatus as in claim 6 and including at least one flow measuring device connected to said suction device.

* * * * *